US006698508B2

(12) United States Patent
Jin et al.

(10) Patent No.: US 6,698,508 B2
(45) Date of Patent: Mar. 2, 2004

(54) FIN AND TUBE TYPE HEAT-EXCHANGER

(75) Inventors: Dae Hyun Jin, Kyonggi-do (KR); Byeong Chul Na, Seoul (KR)

(73) Assignee: LG Electronics Inc., Seoul (KR)

( * ) Notice: Subject to any disclaimer, the term of this patent is extended or adjusted under 35 U.S.C. 154(b) by 3 days.

(21) Appl. No.: 10/406,255

(22) Filed: Apr. 4, 2003

(65) Prior Publication Data

US 2003/0188854 A1 Oct. 9, 2003

Related U.S. Application Data

(62) Division of application No. 09/732,903, filed on Dec. 11, 2000, now Pat. No. 6,585,037.

(30) Foreign Application Priority Data

| | | |
|---|---|---|
| Dec. 15, 1999 | (KR) | 1999-58007 |
| Dec. 15, 1999 | (KR) | 1999-58008 |
| Dec. 15, 1999 | (KR) | 1999-58009 |
| Dec. 15, 1999 | (KR) | 1999-58010 |
| Dec. 15, 1999 | (KR) | 1999-58011 |
| Dec. 15, 1999 | (KR) | 1999-58012 |
| Dec. 15, 1999 | (KR) | 1999-58013 |

(51) Int. Cl.[7] ..... F28D 1/02
(52) U.S. Cl. ..... 165/152; 165/181
(58) Field of Search ..... 165/151, 152, 165/181, DIG. 502, DIG. 503, 146

(56) References Cited

U.S. PATENT DOCUMENTS

| | | | | |
|---|---|---|---|---|
| 3,397,741 A | * | 8/1968 | Gunter | 165/152 |
| 5,117,902 A | * | 6/1992 | Kusuhara et al. | 165/151 |
| 5,642,777 A | * | 7/1997 | Kang et al. | 165/146 |
| 5,667,006 A | * | 9/1997 | Kang et al. | 165/151 |
| 5,755,281 A | * | 5/1998 | Kang et al. | 165/151 |
| 6,026,893 A | * | 2/2000 | Jung et al. | 165/151 |

FOREIGN PATENT DOCUMENTS

| | | | | |
|---|---|---|---|---|
| JP | 36121769 A | * | 9/1986 | 165/151 |

* cited by examiner

*Primary Examiner*—Terrell McKinnon
(74) *Attorney, Agent, or Firm*—Birch, Stewart, Kolasch & Birch, LLP

(57) ABSTRACT

A fin and tube type heat-exchanger having a plurality of 6 mm or smaller heat tubes to allow refrigerant to move therein includes a plurality of cooling fins arranged at predetermined intervals, each cooling fin having a number of joint holes arranged in one or more stages, and a number of slits between the joint holes formed on each stage. Each slit has a projecting segment with an open portion corresponding to the direction of air flow and a pair of standing segments formed at both sides of the projecting segment for guiding the direction of air flow. The projecting segments project in the same direction from the surface of each cooling fin, and the slits are grouped in five rows. The heat tubes pass through and are jointed with the joint holes, respectively. The heat exchanger reduces pressure loss, optimizes heat-exchange efficiency, reduces manufacturing costs, and adapts to alternative refrigerants.

4 Claims, 15 Drawing Sheets

FIN AND TUBE TYPE HEAT-EXCHANGER

CROSS-REFERENCE TO RELATED APPLICATIONS

This is a divisional of application Ser. No. 09/732,903, filed Dec. 11, 2000, now U.S. Pat. No. 6,585,037 the entire disclosure of which is hereby incorporated by reference and for which priority is claimed under 35 U.S.C. §120, and this application claims priority under 35 U.S.C. §119 of Korean Application Nos. 1999-58007, 1999-58008, 1999-58009, 1999-58010, 1999-58011, 1999-58012, and 1999-58013, filed Dec. 15, 1999, the entire disclosures of which are hereby incorporated by reference.

BACKGROUND OF THE INVENTION

1. Field of the Invention

The present invention relates to a fin and tube type heat-exchanger, and more particularly, to a fin and tube type heat-exchanger of small size, which is capable of reducing the manufacturing cost, having a more increased efficiency in comparison with conventional heat-exchangers, and reducing power consumption of a motor caused by pressure loss.

2. Description of the Related Art

In general, a heat exchanger is an equipment applied to heating and cooling cycles. The heat exchanger is used mostly for heat exchange between refrigerant moving inside the heating and cooling cycle and gas moving outside the heating and cooling cycle and performs giving and receiving of heat between fluids, such as air.

FIGS. 1 to 3 show a fin and tube type heat-exchanger of the conventional heat-exchangers.

Such heat-exchanger is configured in such a manner that a number of plate type cooling fins are arranged at right angles to the arranged direction of heat tubes 10, in which fluid flows, to enlarge an area of a heat transfer surface, thereby maximizing heat-exchange efficiency.

That is, a number of joint holes 21 are arranged along the longitudinal direction of the cooling fin 20 on the surface of each cooling fin. The heat tube 10 passes through each joint hole 21 for joint.

At this time, the joint holes are arranged in the form of zigzag forming two stages in an upper part and a lower part of the cooling fins.

Furthermore, a number of slits are formed along the direction of air flow (i.e., the shorter side direction of the cooling fin) between the joint holes 21 arranged side by side at the same stage on the cooling fin. The slit includes a number of projecting segments 22*a*, each of which has an open portion for allowing air to move and a number of standing segments 22*b* which are formed at both sides of the slits and induce the air entered into the open portions to rotate along the circumference of the heat tubes for heat-exchange.

At this time, the projecting segments are reciprocally formed at the front surface and the rear surface of the cooling fin.

Therefore, the refrigerant entered from a refrigerant inlet side of each heat tube 10 by the operation of the cooling cycle refrigerates the heat tube 10 during passing through the heat tube to drop down the temperature of the heat tube, and at the same time, heat source (air) transferred from the outside of the heat-exchanger passes between the cooling fins 20 by the rotation of a fan (not shown).

The air passing between the cooling fins 20 performs heat-exchange with the refrigerant transferred to the heat tube 10, the cooling fins 20 and the projecting segments 22*a*.

At this time, the moving air is dashed against each slit during passing through the open portions formed by the slits 22 of the cooling fins 20, so that the air flow is changed into turbulent flow.

The turbulent flow of air is guided by the standing segments formed at both sides of the slit to flow along the circumference of the heat tube, thereby facilitating heat-exchange efficiency.

The slits formed on each cooling fin of the fin-tube type heat-exchanger, which are constructed as the above, are formed in such a manner that they are grouped by six rows divided into two parts of three rows, which are symmetric with each other along the direction of air flow, from an extension line between the centers of two joint holes arranged side by side at one stage of the cooling fin. The other stage of the cooling fin also has the same construction as the above.

Furthermore, the slits of first and sixth rows, on the basis of the direction of air flow, of the slits of six rows arranged at each stage are divided into three unit slits respectively, and are relatively high in their projecting height in comparison with the other slits, thereby facilitating the turbulent flow of the air.

However, in the prior arts, as described above, the way to improve the fin and tube type heat-exchanger was simply to improve the heat-exchange efficiency by facilitating the turbulent flow of air. It caused a high increase of pressure loss, thereby making an enormous electric consumption, causing a damage of the motor and an occurrence of noise, and increasing the manufacturing cost.

Moreover, the present trend toward miniaturization considered, it is impossible to achieve the miniaturization by the construction of the conventional heat-exchanger. Therefore, the conventional heat-exchanger cannot be manufactured in a small-sized product.

That is, in the conventional heat-exchanger, the diameter of the heat tube is 9.52 mm or 7 mm and the width of the cooling fin is set to be fit to the diameter of the heat tube. Additionally, the arrangement and the shape of each slit formed on the cooling fin are also set to be fit to the diameter of the heat tube. Therefore, although the diameter of the heat tube is reduced to manufacture a small-sized heat-exchanger, there is a limit in reducing the width ($W_1$) of the cooling fin.

Due to the characteristics by the arrangement and the construction of each slit, if the shape of the slit is applied as it is, it causes an increase of fan power due to an excessively turbulent flow of air, thereby resulting in an enormous electric consumption and a damage of the motor.

Furthermore, the slits of six rows of the conventional cooling fin considered, the process to reduce the width of the cooling fin becomes considerably difficult, and thereby it is actually impossible to manufacture the small-sized heat-exchanger in direct connection with the production problem.

SUMMARY OF THE INVENTION

Therefore, it is an object of the present invention to provide a new type heat-exchanger, in which heat tubes are fine tubes with the diameter of 6 mm or smaller, so that the pressure loss is reduced and a decrease of heat-exchange efficiency is prevented.

It is another object of the present invention to provide a new type heat-exchanger with the fine heat tubes, which obtains an optimal efficiency of heat-exchange and reduces a manufacturing cost.

To achieve the above objects, according to a first preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by five rows; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a second preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by five rows, wherein the slits of first and fifth rows on the basis of the direction of air flow are divided into three unit slits and the slits of second, third and fourth rows are in a single segment respectively; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a third preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein each slit of each row is divided into two unit slits; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a fourth preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein the slits of first and fourth rows of the slits of four rows are divided into three unit slits and the slits of second and third rows are in a single segment respectively; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a fifth preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein the slits of first and fourth rows, on the basis of the direction of air flow, of the slits of four rows are divided into three unit slits and the slits of second and third rows are divided into two unit slits; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a sixth preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein the slits of first and fourth rows, on the basis of the direction of air flow, of the slits of four rows are divided into two unit slits and the slits of second and third rows are in a single segment respectively; and, a plurality of heat tubes passing through the joint holes of each cooling fin and joined with the joint holes respectively, each heat tube having the diameter of 5~6 mm or smaller and allowing refrigerant to move therein.

To achieve the above objects, according to a sixth preferred embodiment of the present invention, the fin and tube type heat-exchanger comprises: a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by five rows, wherein the slits of first and fifth rows, on the basis of the direction of air flow, of the slits of five rows are divided into three unit slits, the slits of second and fourth rows are divided into two unit slits and the slit of a third row is in a single segment; and, a plurality of heat tubes passing through the joint holes of each cooling fin and joined with the joint holes respectively, each heat tube having the diameter of 5~6 mm or smaller and allowing refrigerant to move therein.

It is to be understood that both the foregoing general description and the following detailed description are exemplary and explanatory and are intended to provide further explanation of the invention as claimed.

BRIEF DESCRIPTION OF THE DRAWINGS

Other objects, advantages and details of the condenser microphone of this invention appear in the following detailed description of preferred embodiments of the invention, the detailed description referring to the drawings in which.

DETAILED DESCRIPTION OF THE PREFERRED EMBODIMENTS

Figure 1:
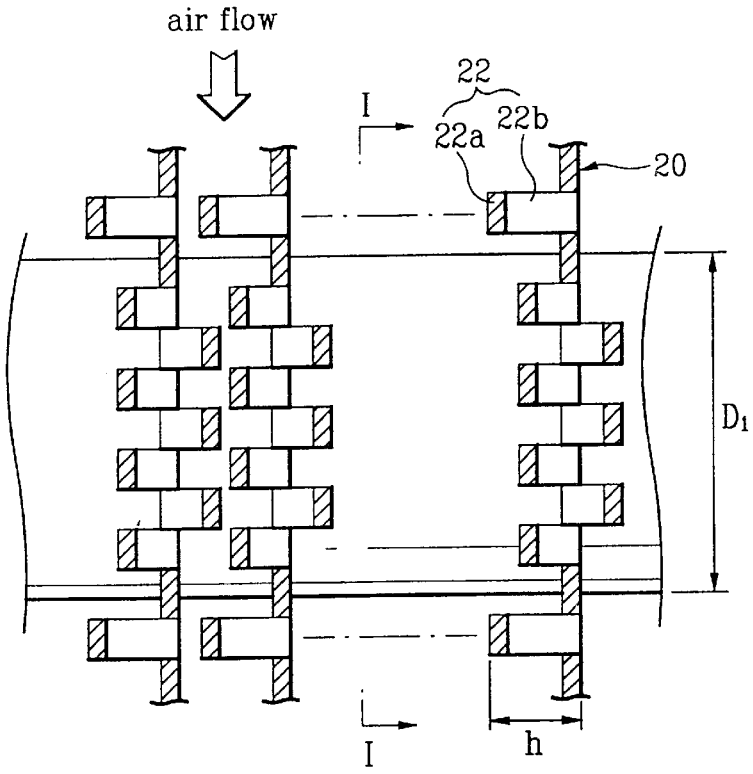
FIG.1 Prior Art
FIG. 1 is a sectional view of essential parts of a conventional fin-tube type heat-exchanger.
Figure 2:
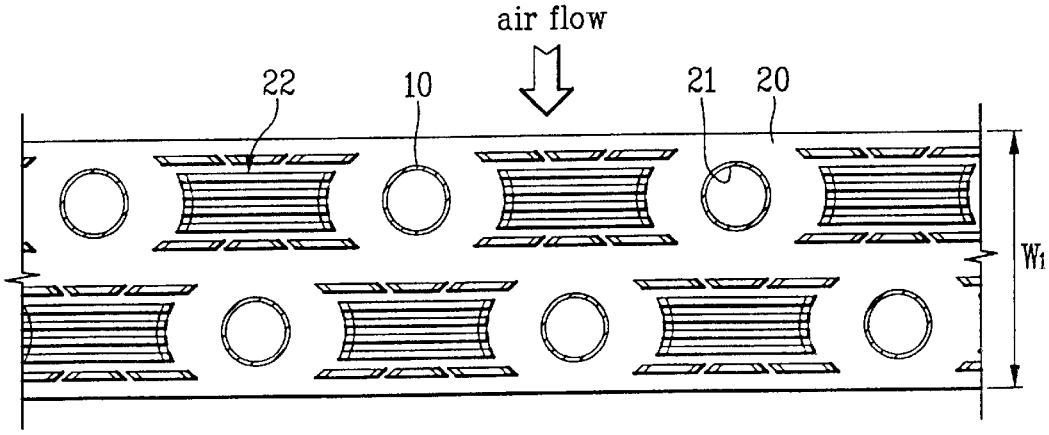
FIG.2 Prior Art
FIG. 2 is a sectional view taken along the line I—I of FIG. 1.
Figure 3:
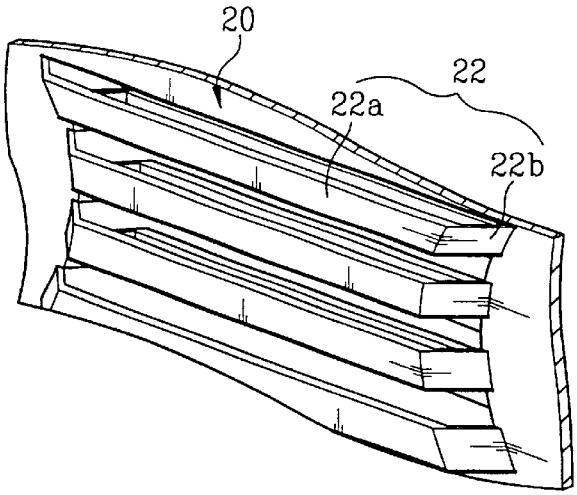
FIG. 3 Prior Art
FIG. 3 is a partially perspective view of a shape of slits formed on cooling fins of the conventional fin-tube type heat-exchanger.

The preferred embodiments according to the present invention will now be described in more detail with reference to the attached drawings.

The present invention includes a number of cooling fins 200 having a plurality of slit groups, in which a number of slits are grouped, and a plurality of heat tubes 100 passing through a plurality of joint holes 210 formed in the cooling fins 200 to be joined with the joint holes 210.

The diameter ($D_2$; 5~6 mm)of each heat tube 100 of the fin and tube type heat-exchanger according to the present invention is smaller than that ($D_1$; 9.52 mm, 7 mm) of each heat tube 10 of the conventional heat-exchanger. The width ($W_2$) of each cooling fin 200 of the fin and tube type heat-exchanger is smaller than that ($W_1$) of each cooling fin 20 of the conventional heat-exchanger. Therefore, the fin and tube type heat-exchanger according to the present invention is different in detailed construction from the conventional heat-exchanger.

Figure 4:
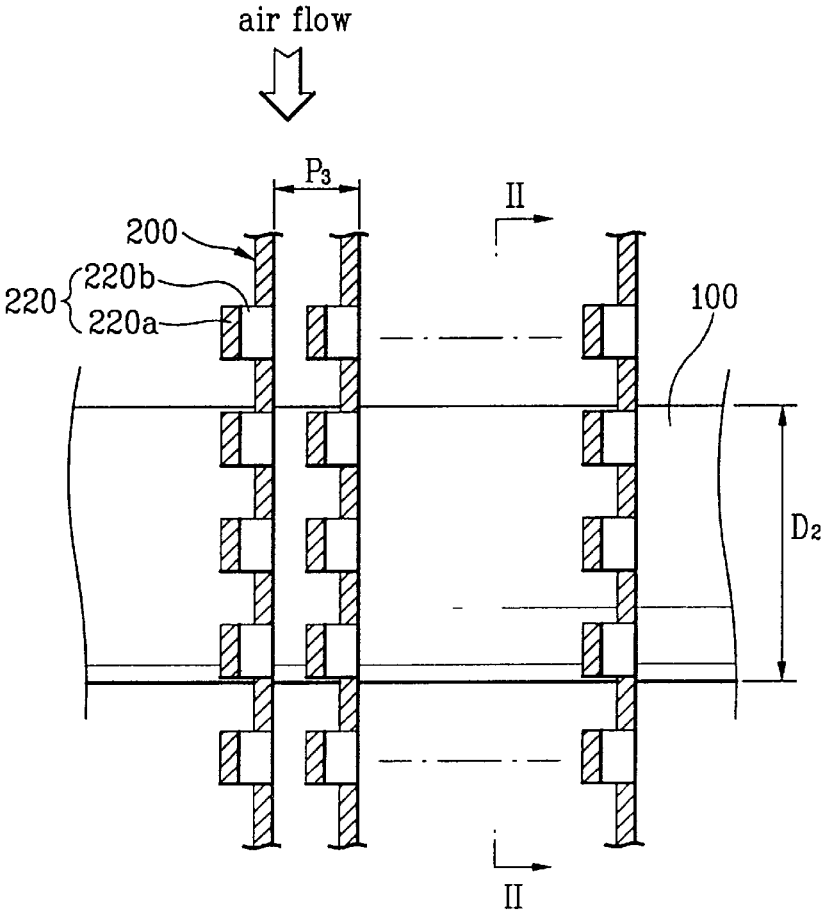
FIG. 4 is a partially sectional view of a fin and tube type heat-exchanger according to a first preferred embodiment of the present invention.
Figure 5:
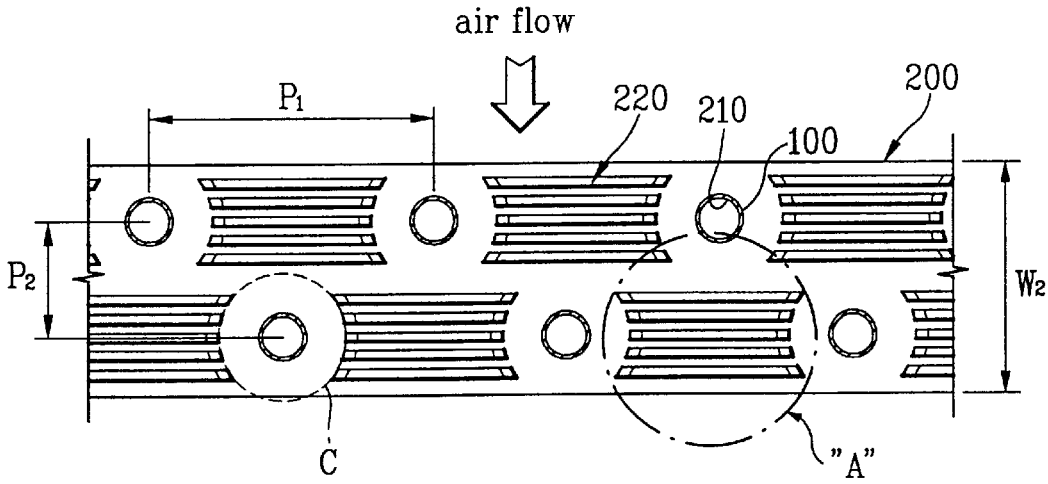
FIG. 5 is a sectional view taken along the line II—II of FIG. 4.
Figure 6:
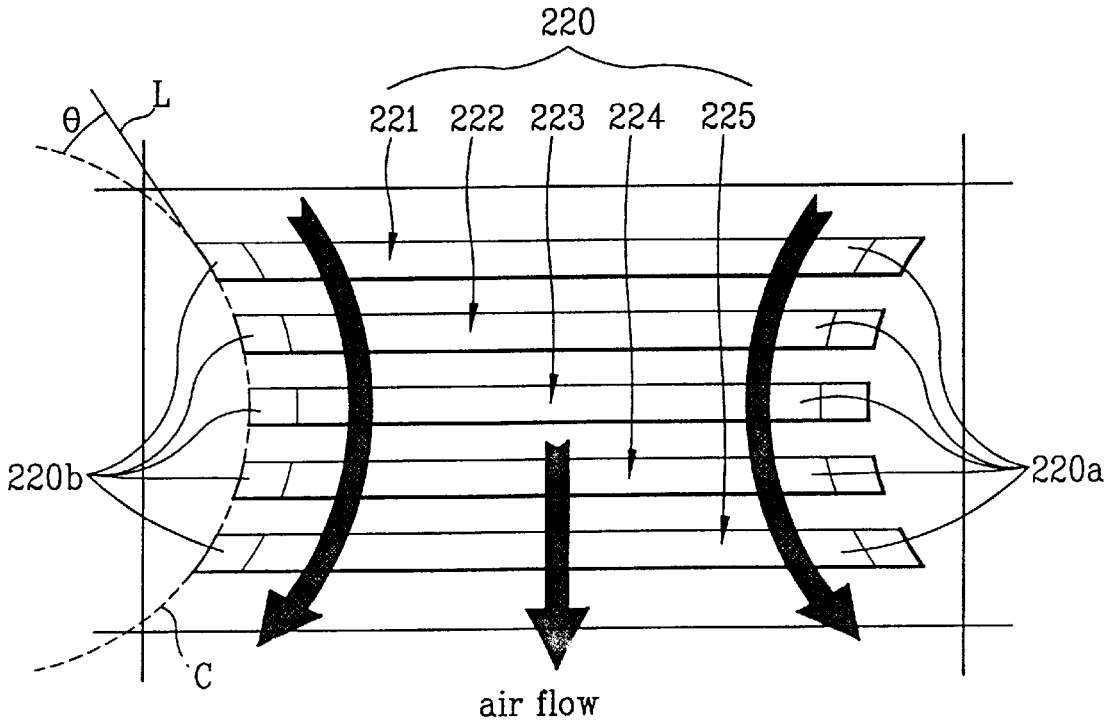
FIG. 6 is an enlarged view of "A" part of FIG. 5.

FIG. 4 is a partially sectional view of a fin and tube type heat-exchanger according to a first preferred embodiment of the present invention. FIG. 5 is a sectional view taken along the line II—II of FIG. 4 and FIG. 6 is an enlarged view of "A" part of FIG. 5.

In the first embodiment according to the present invention, a number of slit groups, in each of which slits 220 are arranged in five rows, are formed on each stage (an upper stage and a lower stage) of each cooling fin 200.

A number of joint holes 210 are formed at the upper stage and the lower stage of the surface of the cooling fin 200. The distance ($P_1$) between the centers of two joint holes, which are arranged side by side at the same stage of each cooling fin 200, is about 19 mm~20 mm.

Furthermore, the distance (P2) between the center of one joint hole formed at the upper stage of each cooling fin 200 and the center of another joint hole formed at the lower stage of each cooling fin 200 is about 10 mm~11 mm.

At this time, if the distances of the stage direction and of the row direction between the joint holes exceed the above ranges, the heat-exchange efficiency is lowered rapidly and the manufacturing cost is considerably increased. In consideration of the results, it is preferable that the distances between the joint holes are made like the above ranges.

Slits 221, 222, 223, 224 and 225 forming one group of five rows are formed in a single segment respectively and projected in the same direction from one surface of the cooling fin 200.

It is to prevent a sudden pressure loss to the utmost and to prevent noise generated by a seriously turbulent flow of air, which may be caused by the narrow distance between the cooling fins in the characteristic point of the fin and tube type heat-exchanger.

That is, projecting segments 220*a* constituting the slits 220 are projected in the same direction from one surface of the cooling fin 200, so that the air passing between the cooling fins can flow smoothly.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 constructed by the above are formed to guide the movement of air flow along the circumferential direction of the heat tubes 100 passing through the joint hole 210 of each cooling fin 200.

That is, each standing segment 220*b* of the slit 220 is formed at a proper angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The angle formed by the above can prevent a stationary state of the air flow, which may occur at a rear stream side of the heat tube 100 after the air was passed.

The shape of each slit formed by the standing segment is shown in FIG. 6.

The slits 221, 222, 224 and 225 of first, second, fourth and fifth rows on the basis of the direction of air flow are in the form of an equiangular trapezoid, in which the open portions are gradually reduced toward the slit 223 of a third row. The open portion of the slit 223 of the third row is generally uniform in width, and thereby, the slit 223 of the third row is in the form of a rectangle.

The heat-exchange process between the indoor air and the refrigerant moving inside the heat tube 100 by the fin and tube type heat-exchanger according to the first preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air flow moves from the outside of the heat-exchanger by the rotation of a fan (not shown). The air passes between the cooling fins 200, and passes each slit 220 formed on the cooling fins during passing the cooling fins.

The heat transferred to the cooling fins 200 and the slits 220 performs the heat-exchange with the air flowing between the cooling fins, and thereby the air is lowered in its temperature. After continuously flowing, the air lowered in temperature is discharged inside a room to perform an air cooling inside the room.

Meanwhile, when it is considered that the slit 221 of the first row, the slit 222 of the second row, the slit 224 of the fourth row and the slit 225 of the fifth row of the slits 221, 222, 223, 224 and 225 formed on each cooling fin are gradually reduced in the length toward the slit 223 of the third row so that the slits are in the form of an equiangular trapezoid, the airs passing between the cooling fins 200 are mixed with each other during passing.

Moreover, the air flow passing the slits during the above process is guided by the standing segments 230 formed at both sides of each slit and flows along the circumference of each heat tube 100.

The air not only performs the heat-exchange with heat transferred to the heat tubes and the slits but also prevents a formation of stationary portions of air flow, which may occur at the rear stream side of the heat tubes 100.

That is, the configuration of the present invention reduces the pressure loss and improves the heat-exchange efficiency.

The projections of slits 221 to 225 are generally directed in the same direction from one surface of the cooling fin 200, so that the air flow moves smoothly and the direction of air flow is induced to the circumference of the heat tube by the standing segments, thereby improving the heat-exchange efficiency generally.

Figure 7:
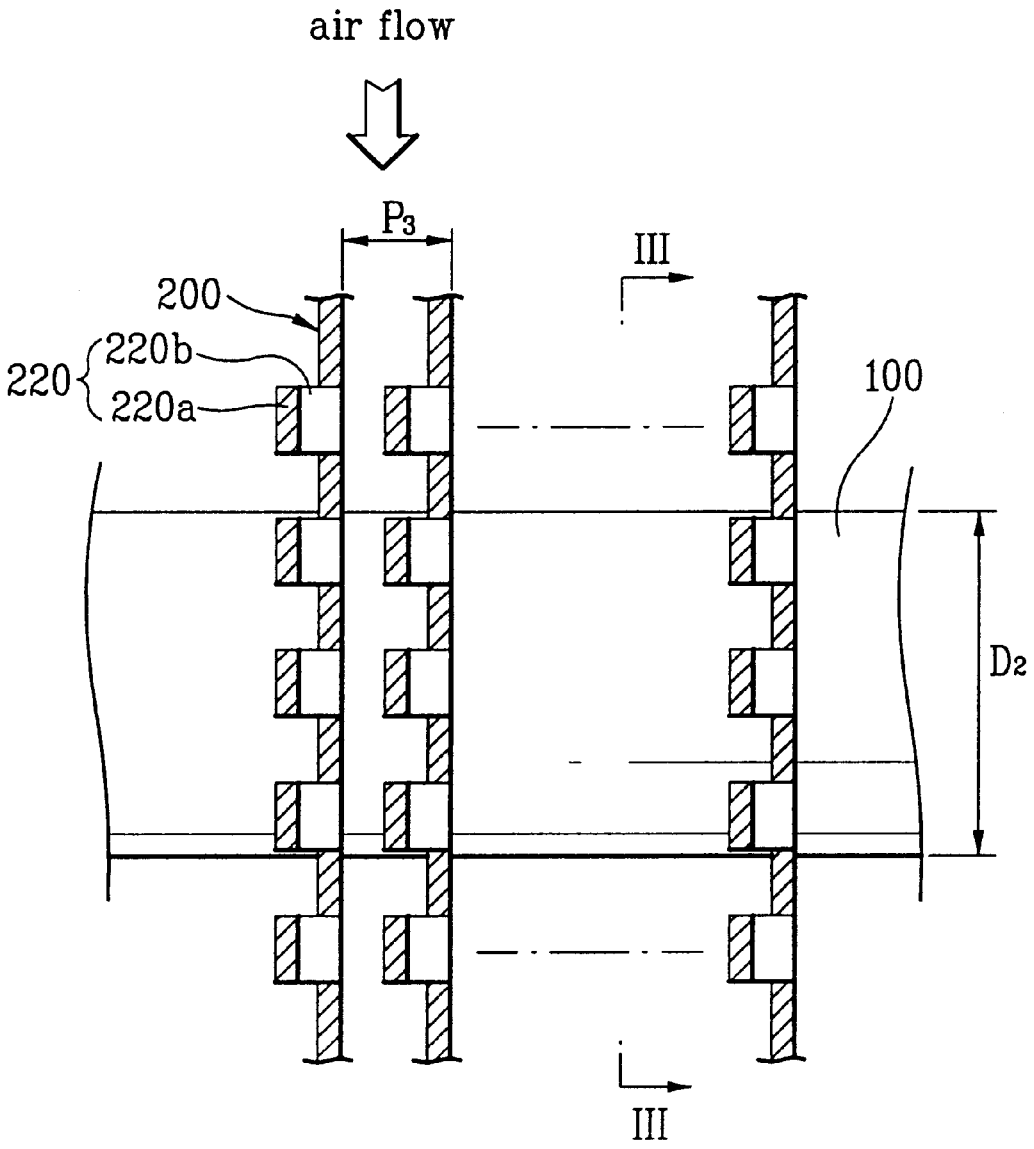
FIG. 7 is a partially sectional view of a fin and tube type heat-exchanger according to a second preferred embodiment of the present invention.
Figure 8:
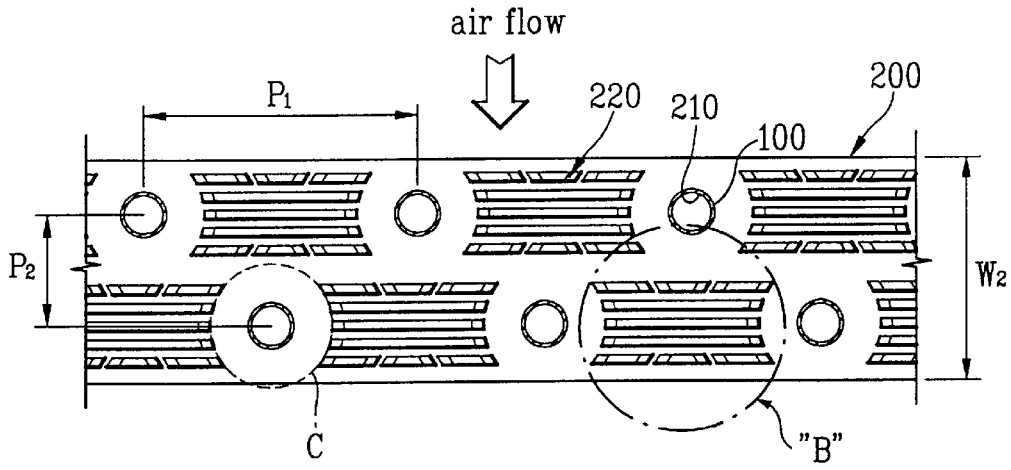
FIG. 8 is a sectional view taken along the line III—III of FIG. 7.
Figure 9:
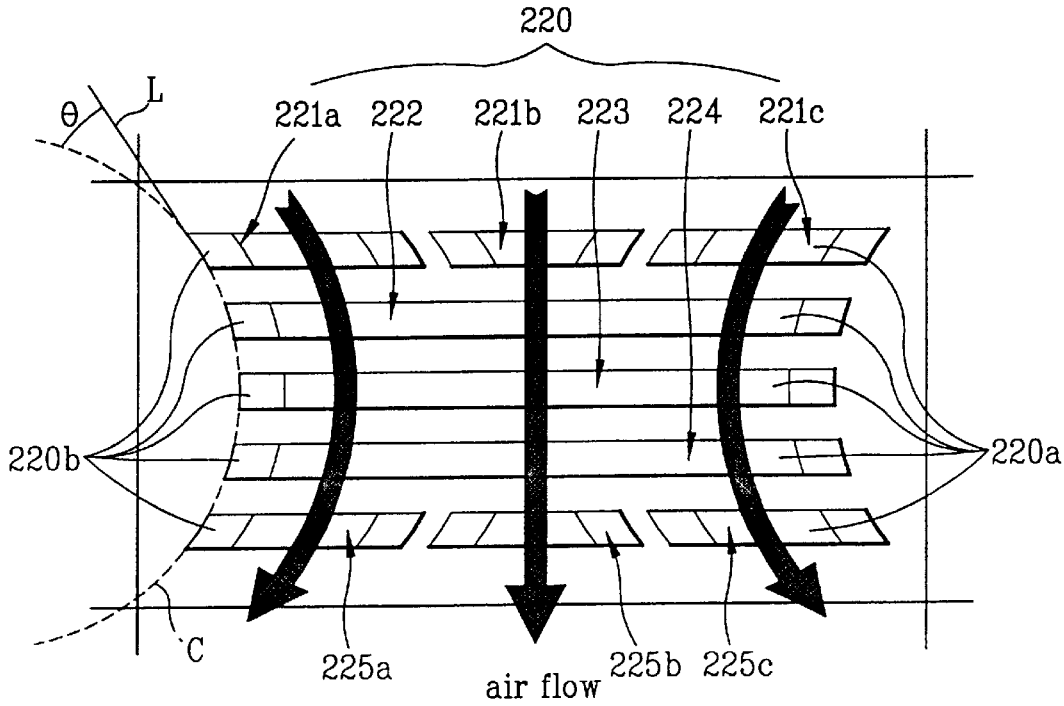
FIG. 9 is an enlarged view of "B" part of FIG. 8.

FIG. 7 is a partially sectional view of a fin and tube type heat-exchanger according to a second preferred embodiment of the present invention. FIG. 8 is a sectional view taken along the line III—III of FIG. 7 and FIG. 9 is an enlarged view of "B" part of FIG. 8.

In the second embodiment according to the present invention, a number of slit groups, in each of which the slits 220 are arranged in five rows, are formed on each stage (the upper stage and the lower stage) of each cooling fin 200.

The distance ($P_1$) between the centers of two joint holes, which are arranged side by side at the same stage of each cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

At this time, the slits 221 and 225 of third and fifth rows, on the basis of the direction of air flow, of the slits arranged in five rows are divided into three unit slits 221*a*, 221*b*, 221*c* and 225*a*, 225*b*, 225*c* respectively. The slits 222, 223 and 224 of second, third and fourth rows are formed in a single segment respectively.

Furthermore, the slits 220 arranged as the above are projected all in the same direction from one surface of the cooling fin 200.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 constructed by the above are formed to guide the movement of air flow along the circumferential direction of the heat tubes 100 passing through the joint holes 210 of the cooling fins 200.

The construction like the above is to make the air flow smooth and to change the air flow passing the slits into turbulent flow well, thereby improving the heat-exchange efficiency.

For this, the standing segments constituting the slits are inclined at a predetermined angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The shape of each slit formed by the standing segment is shown in FIG. 9.

The unit slits 221*b* and 225*b*, located at the centers respectively, of the unit slits 221*a* to 221*c* and 225*a* to 225*c* of the first and fifth rows on the basis of the direction of air flow are in the form of an equiangular trapezoid, in which the open portions are gradually reduced toward each other's row.

The unit slits 221*a*, 221*c*, 225*a* and 225*c*, which is located at both sides of the central unit slits 221*b* and 225*b*, are inclined toward the unit slits 221*b* and 225*b*, so that they are in the form of a parallelogram.

Moreover, the slits 222 and 224 of the second and fourth rows on the basis of the direction of air flow are in the form of an equiangular trapezoid, in which the open portions are gradually reduced toward each other's row.

The heat-exchange process between the indoor air and the refrigerant moving inside the heat tube 100 by the fin and tube type heat-exchanger according to the second preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air moves from the outside of the heat-exchanger by the rotation of a fan (not shown). The air passes between the cooling fins 200, and passes the open portion of the slit of the first row in each slit group of the cooling fin.

At this time, the slit of the first row, which is divided into three unit slits 221*a*, 221*b* and 221*c*, allows the air flow to be distributed even generally by a guidance of the slits.

Additionally, the air flowing along the inside of each slit, during passing the slits 222, 223 and 224 of the second, third and fourth rows in order, performs heat-exchange with latent heat of the refrigerant transferred to the cooling fins 200 through the heat tubes 100.

The air, during passing the slit 225 of the fifth row, is diffused and emitted to the place where the joint hole is formed at the other stage of the cooling fin 200. At that time, the air performs heat-exchange with latent heat of the heat tube 100 joined to the joint hole.

Furthermore, when it is considered that the projecting segment 220*a* of each slit 220 formed on the cooling fin 200 is projected to be opened along the direction of air flow, the air flow, which passes the open portion of each slit 220, is guided by the standing segments 220*b* constituting the slit.

At this time, each standing segment is generally inclined along the circumferential direction of the heat tube 100, and thereby the air flow is moved along the circumference of the heat tube 100 while guided by the standing segments.

The movement of air flow has an influence onto the rear side of the heat tube 100, thereby preventing an occurrence of dead area of air flow, which was formed at the rear side of the conventional heat tube.

Moreover, the change of the direction of air flow by the standing segments makes the air passing each slit 220 be changed into turbulent flow while guided in the movement by each standing segment 220*b*, so that the rate of heat transfer is increased to perform a more smooth heat-exchange.

However, it is preferable that the turbulent flow of air is not high in its level and does not reduce heat-exchange efficiency.

The reason is that the slits 220 formed on each cooling fin 200 are projected from one surface of the cooling fin in the same direction to allow a smooth movement of air flow.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

Figure 10:
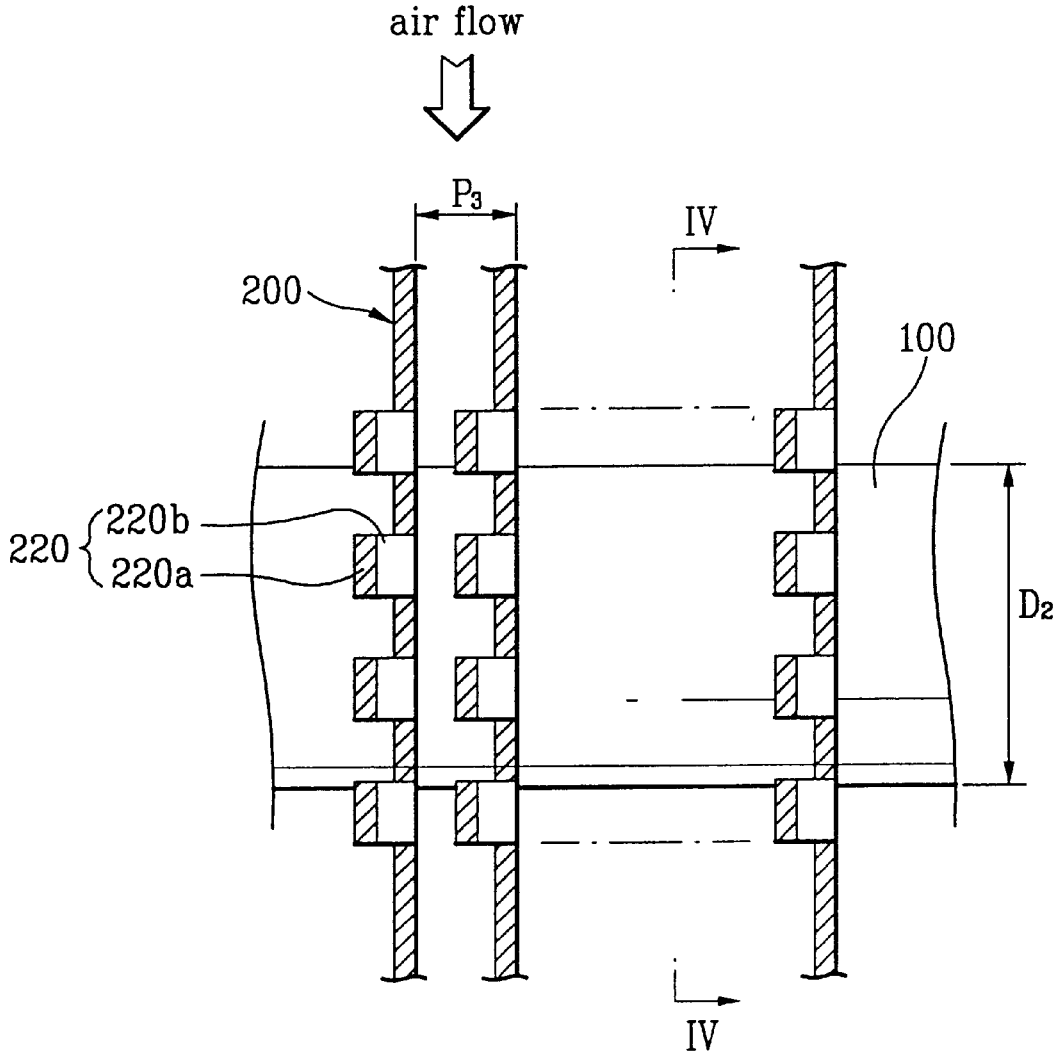
FIG. 10 is a partially sectional view of a fin and tube type heat-exchanger according to a third preferred embodiment of the present invention.
Figure 11:
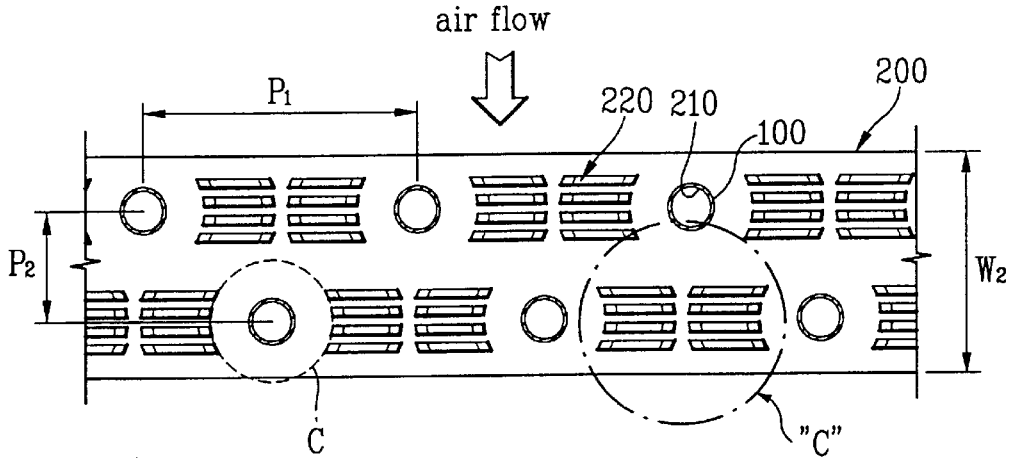
FIG. 11 is a sectional view taken along the line IV—IV of FIG. 10.
Figure 12:
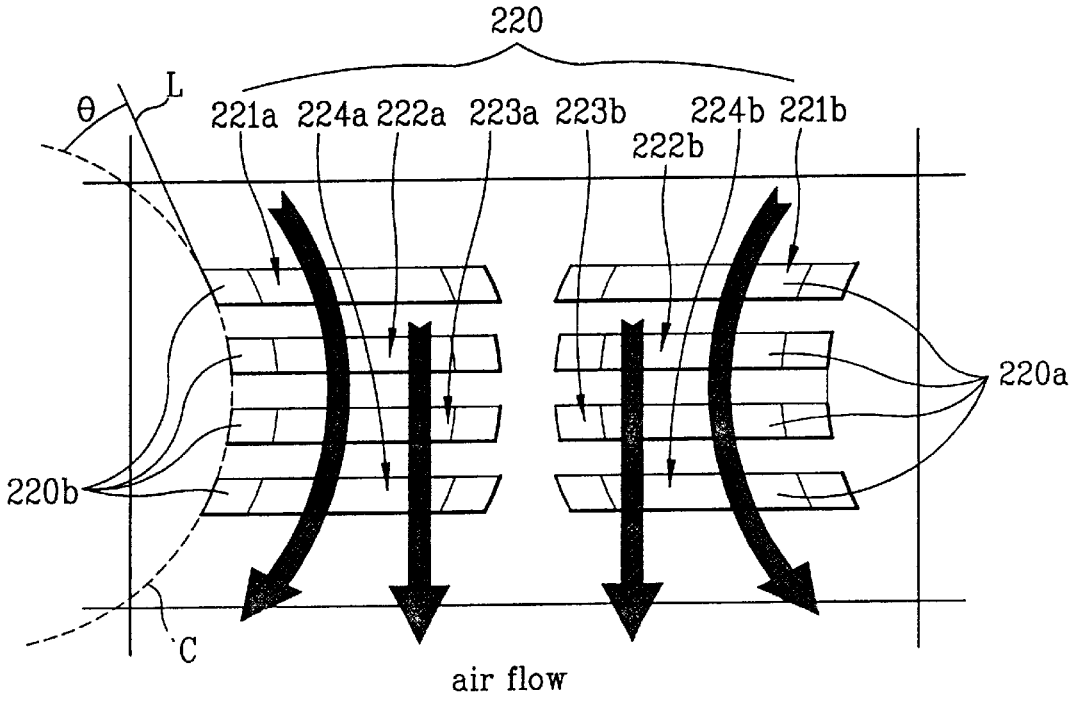
FIG. 12 is an enlarged view of "C" part of FIG. 11.

FIG. 10 is a partially sectional view of a fin and tube type heat-exchanger according to a third preferred embodiment of the present invention. FIG. 11 is a sectional view taken along the line IV—IV of FIG. 10 and FIG. 12 is an enlarged view of "C" part of FIG. 11.

In the third embodiment according to the present invention, a number of slit groups, in each of which the slits 220 are arranged in four rows, are formed on each stage (the upper stage and the lower stage) of each cooling fin 200.

The distance ($P_1$) between the centers of two joint holes, which are arranged side by side at the same stage of the cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

At this time, the slits, which are grouped by four rows, are divided into two unit slits 221*a*, 221*b*, 222*a*, 222*b*, 223*a*, 223*b*, 224*a* and 224*b* every row respectively.

The above configuration is to have a smooth air flow and to change the air flow passing each slit 220 into turbulent flow, thereby causing an improvement of heat-exchange efficiency.

Furthermore, the slits 220 arranged as the above are projected all in the same direction from one surface of the cooling fin 200.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 constructed by the above are formed to guide the movement of air flow along the circumferential direction of the heat tubes 100 passing through the joint holes 210 of the cooling fins 200.

For this, the standing segments constituting each slit are inclined at a predetermined angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The shape of each slit formed by the standing segment 220*b* is shown in FIG. 12.

The unit slits 221*a*, 221*b*, 222*a* and 222*b* of the first and second rows on the basis of the direction of air flow are in the form of a parallelogram, which are inclined toward the center of the slit group on the basis of the space between the unit slits 222*a* and 222*b* of the second row and the unit slits 223*a* and 223*b* of the third row.

Furthermore, the unit slits 223*a* 223*b*, 224*a* and 224*b* of the third and fourth rows are in the form of a parallelogram, which are symmetric with respect to the form of the unit slits of the first and second rows.

The heat-exchange process between the indoor air and the refrigerant moving inside the heat tube 100 by the fin and tube type heat-exchanger according to the third preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air flow moves from the outside of the heat-exchanger by the rotation of a fan (not shown). The air passes between the cooling fins 200, and passes the open portion of the slit of the first row in each slit group of four rows during passing the cooling fins 200.

At this time, because the slit of the first row is divided into two unit slits 221*a* and 221*b* and the standing segments 220*b* are inclined to collect the entered air on the center, the air flow passing the unit slits is guided by the standing segments 220*b* and collected on the center, and at the same time, the air flow passing each slit is joined together to form the turbulent flow.

Moreover, when the air, which passed the unit slits 221*a* and 221*b* of the first row, passes the unit slits 222*a*, 222*b*, 223*a* and 223*b* of the second and third rows in order, the air flow is guided by the standing segments 220*b* of the slit to make an even distribution of air flow generally.

When passing three unit slits 224*a* and 224*b* of the fourth row, the air flow is guided by the standing segments 220*b* of the unit slits and diffused to the rear side of the heat tube 100 located at both side portions of the slit group 220, thereby performing heat-exchange continuously.

That is, as described above, the air flow passing each slit 220 of one slit group is guided by the standing segments 220*b* constituting each slit, and thereby moves along the circumference of the heat tube 100.

The movement of air flow has an influence onto the rear side of the heat tube 100, thereby preventing an occurrence of dead area of air flow, which was formed at the rear side of the conventional heat tube.

According to this embodiment of the present invention, each of the plural slit groups 220 formed on the cooling fin 200 has the slits arranged in four rows, the slits are all divided into two unit slits, and each unit slit, which has its own shape, guides the direction of air flow at need, thereby obtaining the smooth heat-exchange efficiency caused by the turbulent flow of air.

Furthermore, the slits 220 formed on the cooling fin 200, which are projected in the same direction from one surface of the cooling fin, allow the air to flow more smoothly and prevent the pressure loss, which may occur while the air passes between the cooling fins 200.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

Figure 13:
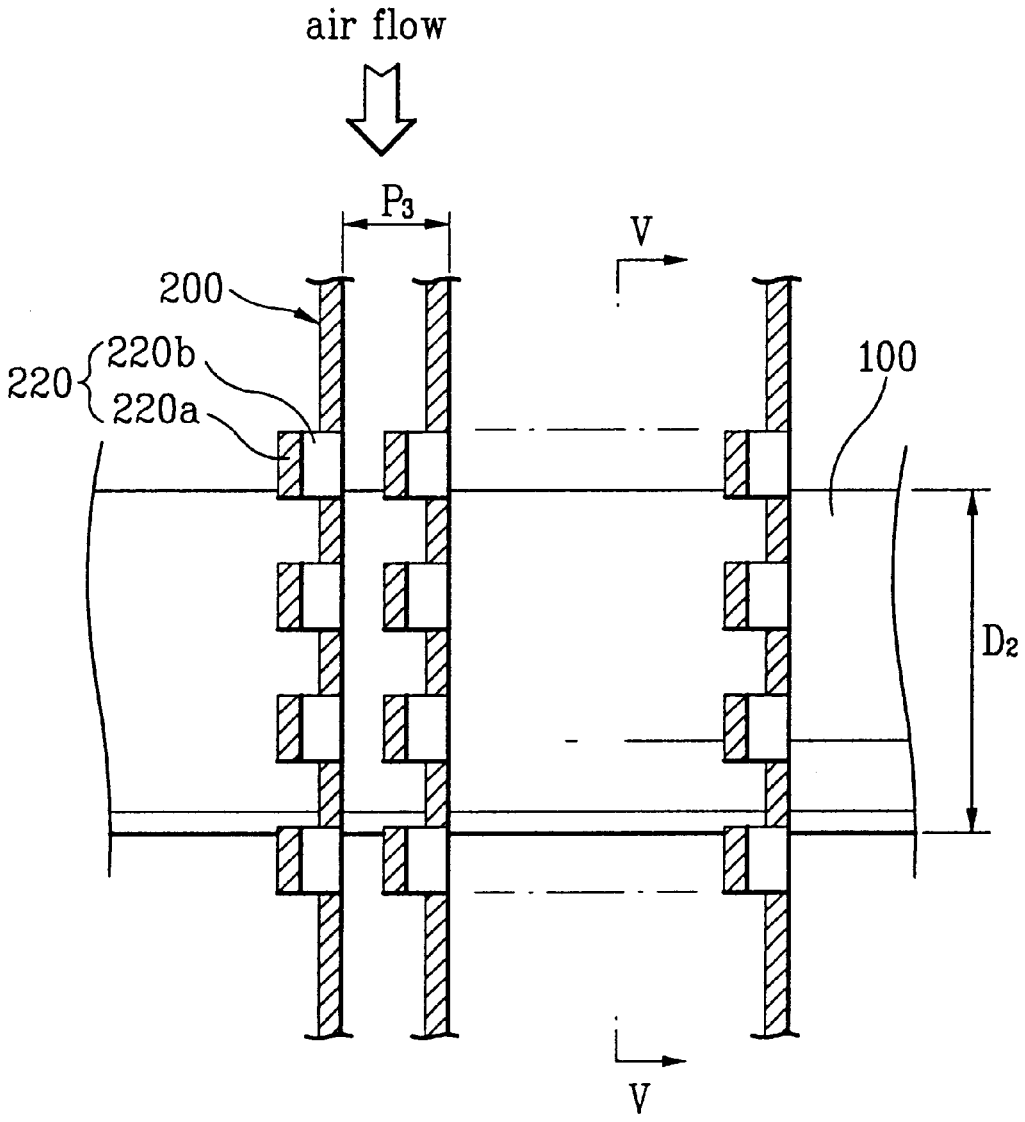
FIG. 13 is a partially sectional view of a fin and tube type heat-exchanger according to a fourth preferred embodiment of the present invention.
Figure 14:
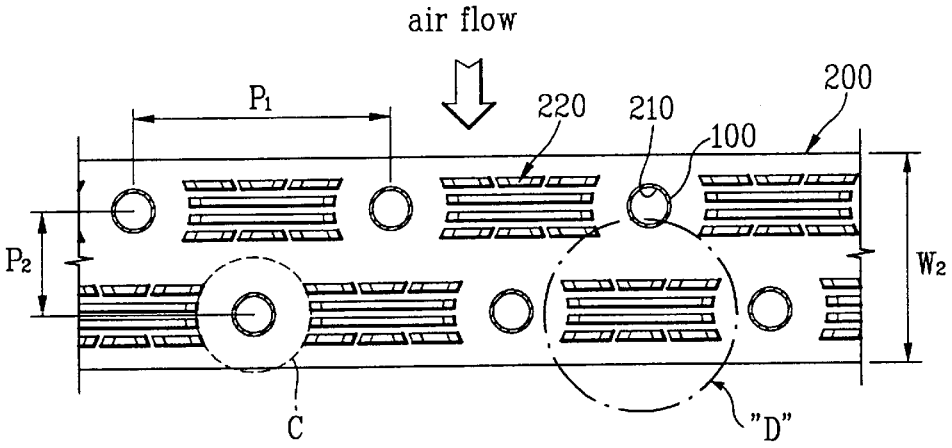
FIG. 14 is a sectional view taken along the line V—V of FIG. 13.
Figure 15:
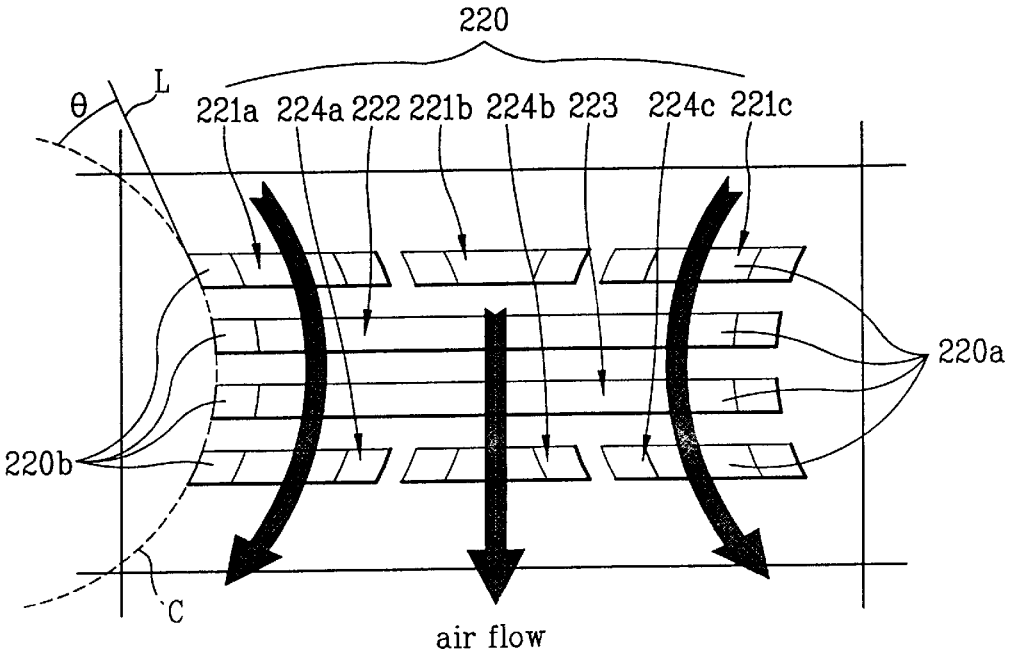
FIG. 15 is an enlarged view of "D" part of FIG. 14.

FIG. 13 is a partially sectional view of a fin and tube type heat-exchanger according to a fourth preferred embodiment of the present invention. FIG. 14 is a sectional view taken along the line V—V of FIG. 13 and FIG. 15 is an enlarged view of "D" part of FIG. 14.

In the fourth embodiment according to the present invention, a number of slit groups, in each of which the slits 220 are arranged in four rows, are formed on each stage (the upper stage and the lower stage) of each cooling fin 200.

The distance ($P_1$) between the centers of two joint holes, which are arranged side by side at the same stage of the cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

At this time, the slits of first and fourth rows, on the basis of the direction of air flow, of the slits of four rows are divided into three unit slits 221*a* to 221*c* and 224*a* to 224*c* respectively. The slits 222 and 223 of second and third rows are formed in a single segment respectively.

Furthermore, the slits 220 arranged as the above are projected all in the same direction from one surface of the cooling fin 200.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 constructed by the above are formed to guide the movement of air flow along the circumferential direction of the heat tubes 100 passing through the joint holes 210 of the cooling fins 200.

For this, the standing segments constituting the slits are inclined at a predetermined angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The shape of each slit formed by the standing segment is shown in FIG. 15.

The unit slits 221*b* and 224*b*, located at the centers respectively, of the unit slits 221*a* to 221*c* and 224*a* to 224*c* of the first and fifth rows are in the form of an equiangular trapezoid, in which the open portions are gradually reduced toward the slits 222 and 223 of the second and third rows when seen from the front.

The unit slits 221*a*, 221*c*, 224*a* and 224*c*, which is located at both sides of the central unit slits 221*b* and 224*b*, are inclined toward the unit slits 221*b* and 225*b*, so that they are in the form of a parallelogram.

Moreover, the slits 222 and 223 of the second and third rows on the basis of the direction of air flow are in the form of an equiangular trapezoid, in which the open portions are gradually reduced toward each other's row.

The heat-exchange process between the indoor air and the refrigerant moving inside the heat tube 100 by the fin and tube type heat-exchanger according to the fourth preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air flow moves from the outside of the heat-exchanger by the rotation of a fan (not shown). The air passes between the cooling fins 200, and passes the open portion of the slit of the first row in each slit group of the cooling fin.

At this time, the slit of the first row, which is divided into three unit slits 221*a*, 221*b* and 221*c*, allows the air flow to be distributed generally even by a guidance of the slits.

Additionally, the air flowing along the inside of each slit, during passing the slits 222 and 223 of the second and third rows and the unit slits 224*a*, 224*b* and 224*c* of the fourth row in order, performs heat-exchange with latent heat of the refrigerant transferred to the cooling fin 200 through the heat tube 100.

Furthermore, when it is considered that the projecting segments 220*a* of the slits 220 formed on each cooling fin 200 are projected to be opened along the direction of air flow, the air flow, which passes the open portion of each slit 220, is guided by the standing segments 220*b* constituting the slits.

At this time, each standing segment is generally inclined along the circumference of the heat tube 100, and thereby the air flows along the circumferential direction of the heat tube 100 while guided by the standing segments.

The movement of air flow has an influence onto the rear side of the heat tube 100, thereby preventing an occurrence of dead area of air flow, which was formed at the rear side of the conventional heat tube.

Moreover, the change of the direction of air flow by the standing segments makes the air flow passing each slit 220 be changed into turbulent flow while guided by the standing segments 220*b*, so that the rate of heat transfer is increased to perform more smooth heat-exchange.

However, it is preferable that the turbulent flow of air is not high in its level and does not reduce heat-exchange efficiency.

The reason is that the slits 220 formed on each cooling fin 200 are projected from one surface of the cooling fin in the same direction to allow a smooth movement of air flow.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

Figure 16:
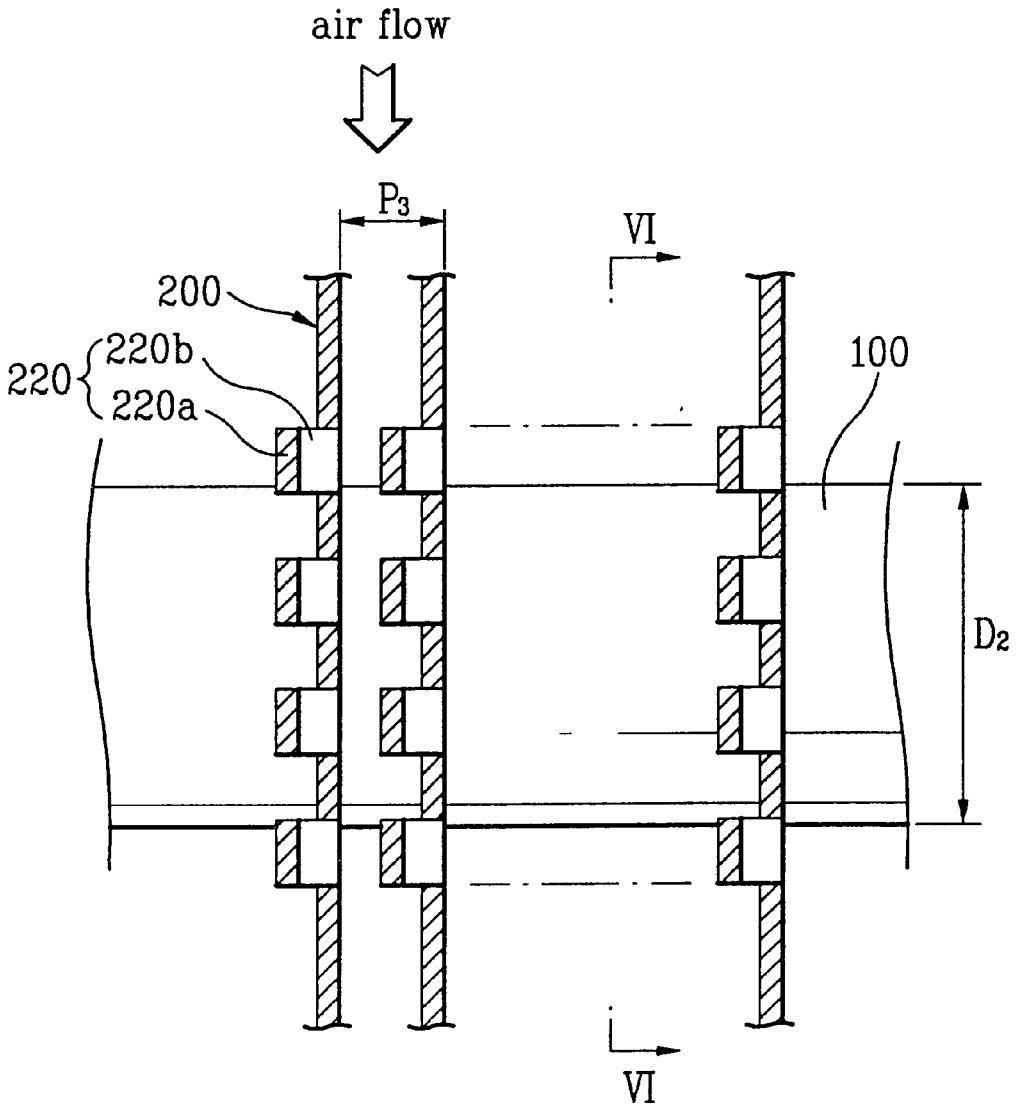
FIG. 16 is a partially sectional view of a fin and tube type heat-exchanger according to a fifth preferred embodiment of the present invention.
Figure 17:
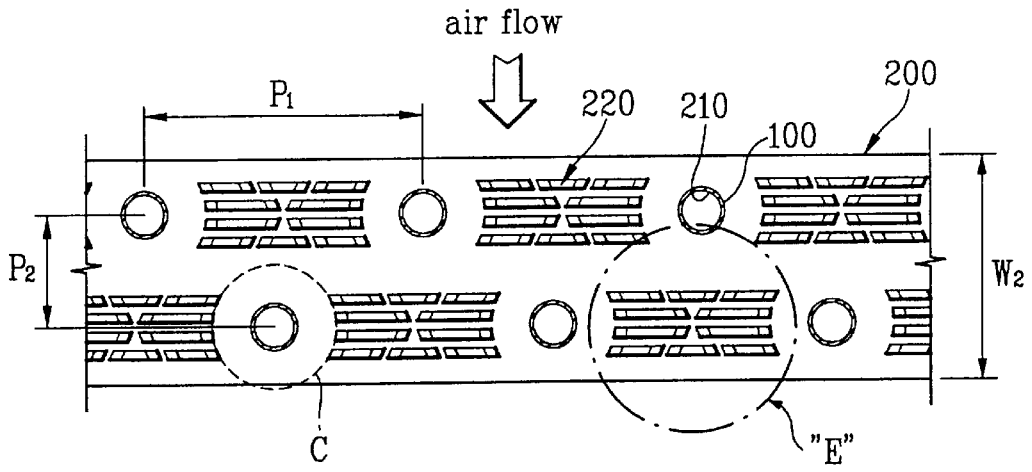
FIG. 17 is a sectional view taken along the line VI—VI of FIG. 16.
Figure 18:
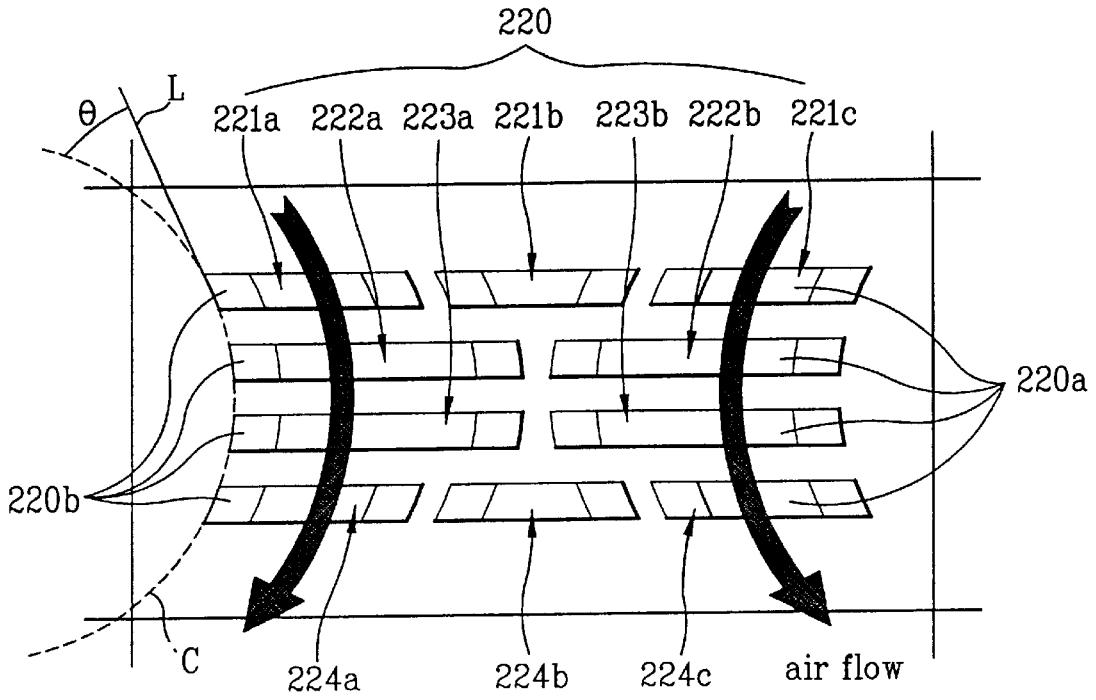
FIG. 18 is an enlarged view of "E" part of FIG. 17.

FIG. 16 is a partially sectional view of a fin and tube type heat-exchanger according to a fifth preferred embodiment of the present invention. FIG. 17 is a sectional view taken along the line VI—VI of FIG. 16 and FIG. 18 is an enlarged view of "E" part of FIG. 17.

In the fifth embodiment according to the present invention, a number of slit groups, in each of which the slits 220 are arranged in four rows, are formed on each stage (the upper stage and the lower stage) of each cooling fin 200.

The distance ($P_1$) between the centers of two joint holes, which are arranged side by side at the same stage of the cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

At this time, the slits of first and fourth rows, on the basis of the direction of air flow, of the slits of four rows are divided into three unit slits 221*a* to 221*c* and 224*a* to 224*c* respectively. The slits 222 and 223 of second and third rows are divided into two unit slits 222*a*, 222*b*, 223*a* and 223*b*.

Furthermore, the slits 220 arranged as the above are projected all in the same direction from one surface of the cooling fin 200.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 constructed by the above are formed to guide the movement of air flow along the circumferential direction of the heat tubes 100 passing through the joint holes 210 of the cooling fins 200.

For this, the standing segments constituting the slits are inclined at a predetermined angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The shape of each slit formed by the standing segment is shown in FIG. 18.

The unit slits 221*b* and 224*b*, located at the centers respectively, of the unit slits 221*a* to 221*c* and 224*a* to 224*c* of the first and fifth rows are in the form of an equiangular trapezoid, in which the open portions are gradually reduced toward the slit of the second row.

The unit slits 221*a*, 221*c*, 224*a* and 224*c*, which is located at both sides of the central unit slits 221*b* and 224*b*, are inclined toward the unit slits 221*b* and 225*b*, so that they are in the form of a parallelogram.

Moreover, the unit slits 222*a*, 222*b*, 223*a* and 223*b* of the second and third rows are in the form of a parallelogram, which make the air flow move toward the center between them.

The heat-exchange process between the indoor air and the refrigerant moving inside the heat tube 100 by the fin and tube type heat-exchanger according to the fifth preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air flows from the outside of the heat-exchanger by the rotation of a fan (not shown). The air passes between the cooling fins 200, and passes the open portion of each unit slit of the first row in each slit group of four rows.

At this time, because the slit of the first row is divided into three unit slits 221*a*, 221*b* and 221*c* and the standing segments 220*b* have differently inclined angles to collect the entered air on the center, the air flow passing the unit slits is guided by the standing segments 220*b* and collected on the center.

At the same time, the air flow passing each slit is joined together to change the air flow into turbulent flow, thereby improving heat-exchange efficiency.

Moreover, when the air flow, which passed the unit slits 221*a*, 221*b* and 221*c* of the first row, passes the unit slits 222*a*, 222*b*, 223*a* and 223*b* of the second and third rows in order, the air flow is guided by the standing segments 220*b* of the slit to make an even distribution of air flow generally.

When passing three unit slits 224*a*, 224*b* and 224*c* of the fourth row, the air flow is guided by the standing segments 220*b* of the unit slits and diffused to the rear side of the heat tube 100 located at both sides of the slit group 220, thereby performing heat-exchange continuously.

That is, as described above, the air flow passing each slit 220 of one slit group is guided by the standing segments 220*b* constituting each slit, and moves along the circumferential direction of the heat tube 100 to perform a more smooth heat-exchange.

The movement of air flow has an influence onto the rear side of the heat tube 100, thereby preventing an occurrence of dead area of air flow, which was formed at the rear side of the conventional heat tube.

Additionally, the change of the direction of air flow by the standing segments makes the air flow passing each slit be changed into turbulent flow while the air flow is guided by the standing segments, thereby increasing the rate of heat transfer and performing the more smooth heat-exchange.

Furthermore, the slits 220 formed on each cooling fin 200, which are projected in the same direction from one surface of the cooling fin, allow the air to flow more smoothly and prevent the pressure loss, which may occur while the air flow passes between the cooling fins 200.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

Figure 19:
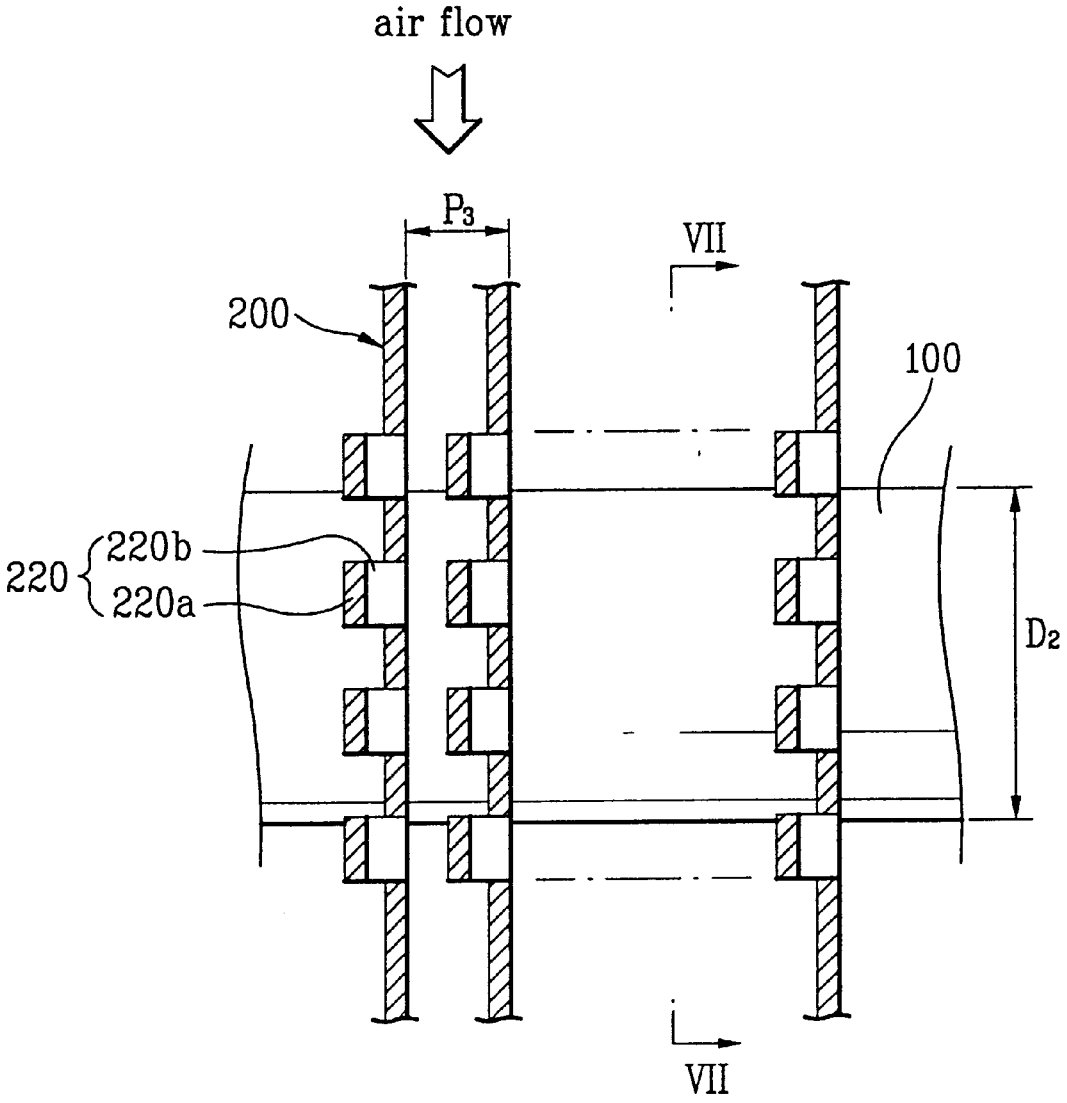
FIG. 19 is a partially sectional view of a fin and tube type heat-exchanger according to a sixth preferred embodiment of the present invention.
Figure 20:
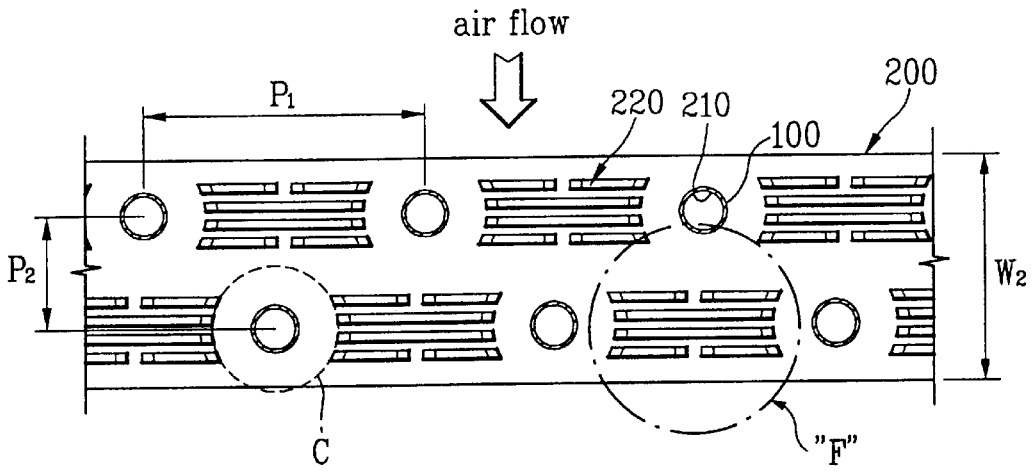
FIG. 20 is a sectional view taken along the line VII—VII of FIG. 19.
Figure 21:
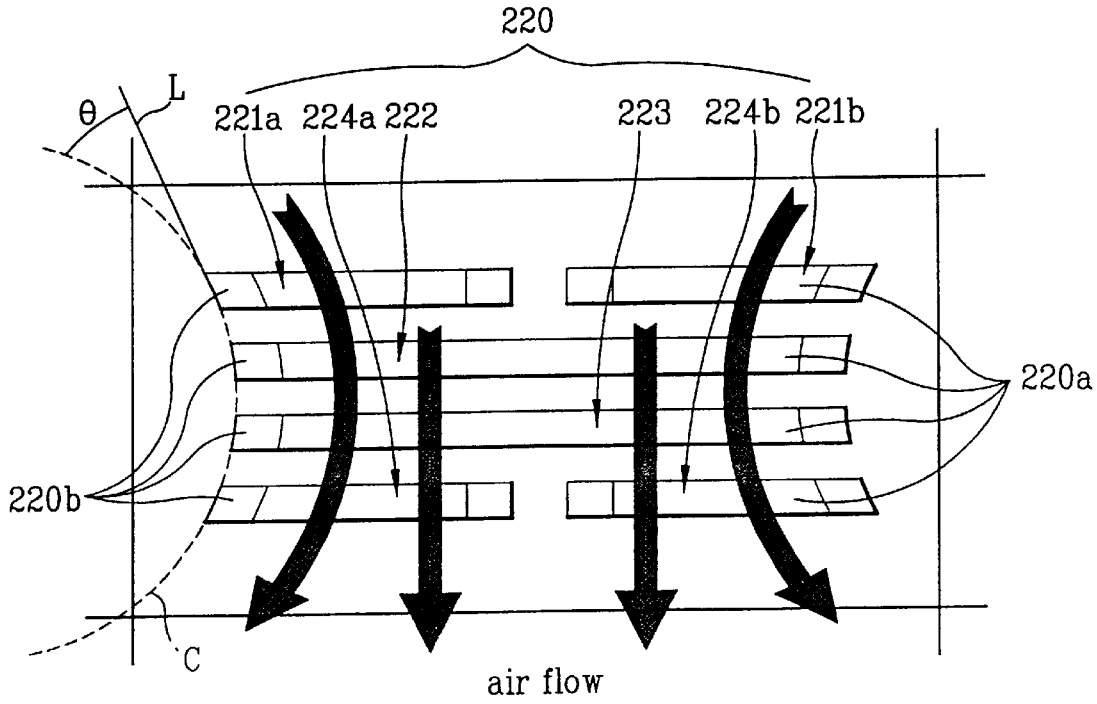
FIG. 21 is an enlarged view of "F" part of FIG. 20.

FIG. 19 is a partially sectional view of a fin and tube type heat-exchanger according to a sixth preferred embodiment of the present invention. FIG. 20 is a sectional view taken along the line VII—VII of FIG. 19 and FIG. 21 is an enlarged view of "F" part of FIG. 20.

In the sixth embodiment according to the present invention, a number of slit groups, in each of which the slits 220 are arranged in four rows, are formed on each stage (the upper stage and the lower stage) of each cooling fin 200.

The distance ($P_1$) between the centers of two joint holes, which are arranged side by side at the same stage of the cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

The slits of first and fourth rows, on the basis of the direction of air flow, of the slits of four rows are divided into two unit slits 221*a*, 221*b*, 224*a* and 224*b* respectively. The slits 222 and 223 of second and third rows are formed in a single segment respectively.

The above configuration is to make the air flow smooth, thereby improving the heat-exchange efficiency and reducing the pressure loss.

Furthermore, the slits 220 arranged like the above are projected all in the same direction from one surface of the cooling fin 200. It is to prevent a sudden pressure loss, which may occur by narrow intervals between the cooling fins 200.

That is, the projecting segments 220*a* constituting each slit 220 are formed in such a manner that they are opened along the same direction from one surface of the cooling fin 200, so that the air passing between the cooling fins flows smooth.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air.

Moreover, the slits 220 configured by the above are formed to guide the air flow along the circumference of the heat tubes 100 passing through the joint holes 210 of the cooling fins 200.

For this, the standing segments constituting the slits are formed at an appropriate angle.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

Therefore, after the air flow passes by the guidance of the standing segments, the stationary state of air flow, which may occur at the rear side of the heat tube, can be prevented.

The shape of each slit formed by the standing segment is shown in FIG. 21.

The unit slits 221*a*, 221*b*, 224*a* and 224*b* of the first and fourth rows on the basis of the direction of air flow are in the form of a parallelogram, which are inclined inwardly toward the center of them. The slits 222 and 223 of the second and third rows are in the form of an equiangular trapezoid, in which the open portion are gradually reduced toward each other's row.

At this time, the standing segments, which are located at the inside portions of the unit slits 221*a*, 221*b*, 224*a* and 224*b*, as shown in FIG. 21, are formed without having any inclined angle to reduce the pressure loss, thereby reducing ventilation noise.

The heat-exchange process between the indoor air and the refrigerant moving inside the heat tube 100 by the fin and tube type heat-exchanger according to the sixth preferred embodiment will be described hereinafter in more detail.

First, the refrigerant entered from the refrigerant inlet side of the heat tubes 100 transfers heat to the heat tubes 100 and the cooling fins 200 mounted in contact with the heat tubes 100 during passing through the heat tubes 100.

At this time, the air moves from the outside of the heat-exchanger by the rotation of a fan (not shown). The air passes between the cooling fins 200, and passes the open portion of the slit of the first row in each slit group of the cooling fin.

At this time, the slit of the first row, which is divided into two unit slits 221*a* and 221*b*, allows the air flow to be distributed even generally by a guidance of the slits.

Additionally, the air flow moving along the inside of each slit, during passing the unit slits 224*a* and 224*b* of the fourth row, is guided by the standing segments 220*b* and diffused toward the rear side of the heat tubes 100 located at both sides of each slit group 200, thereby performing heat-exchange continuously.

That is, as previously described, the air flow passing each slit 220 of one slit group is guided by the standing segments 220*b* constituting each slit and moves along the circumferential direction of the heat tube 100, thereby performing a more smooth heat-exchange.

Furthermore, by the above function, the air flow has an influence onto the rear side of the heat tube 100, thereby preventing an occurrence of dead area of air flow, which was formed at the rear side of the conventional heat tube.

Moreover, the slits, which are grouped by four rows, formed on the cooling fin 200 make the air flow more smooth, thereby preventing the pressure loss due to the air flow between the cooling fins 200.

Additionally, the slits 220 formed on each cooling fin 200 is projected in the same direction from one surface of the cooling fin, so that the air flow moves more smooth and the pressure loss, which may occur while the air passes between the cooling fins, can be prevented.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

Figure 22:
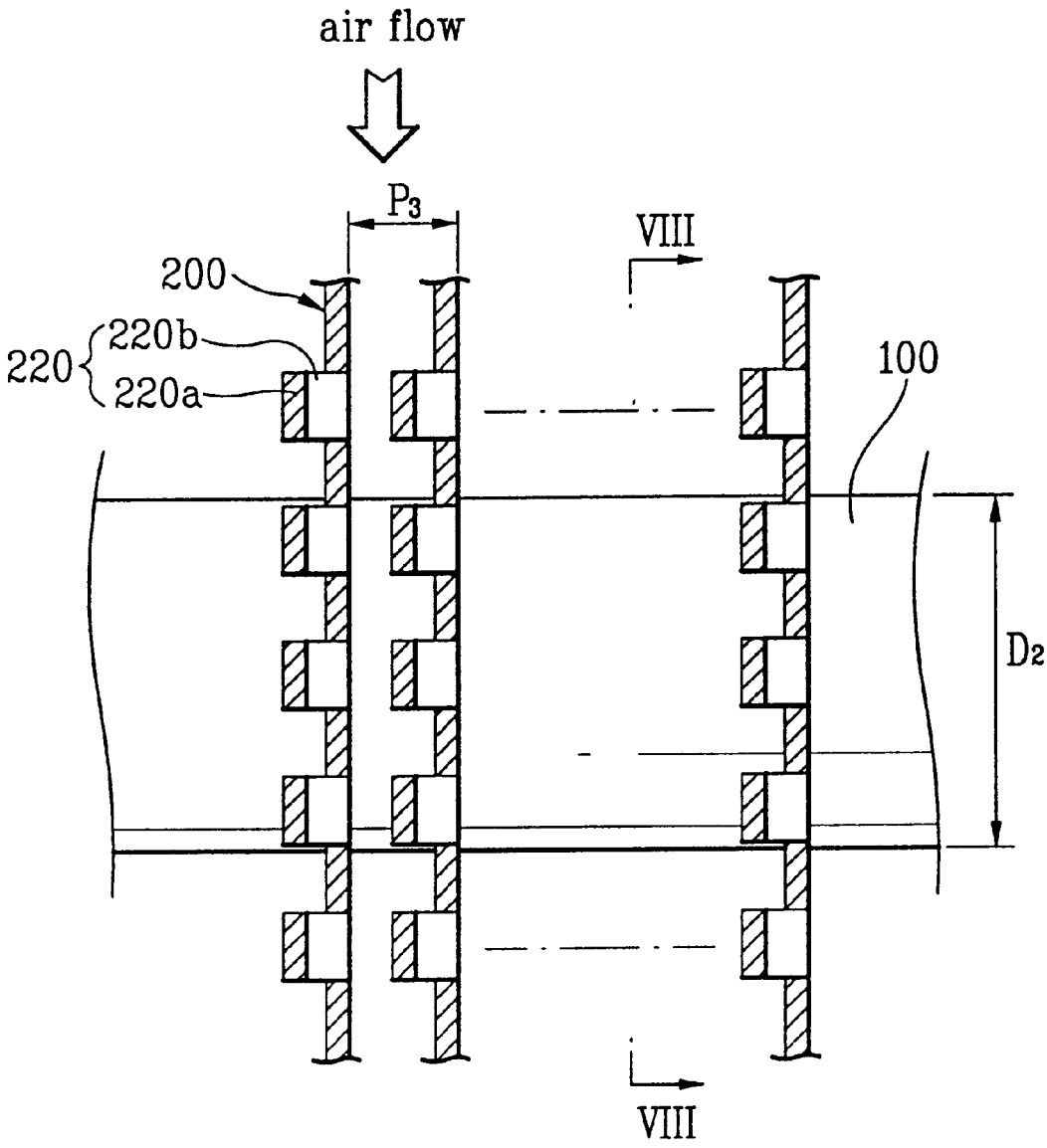
FIG. 22 is a partially sectional view of a fin and tube type heat-exchanger according to a seventh preferred embodiment of the present invention.
Figure 23:
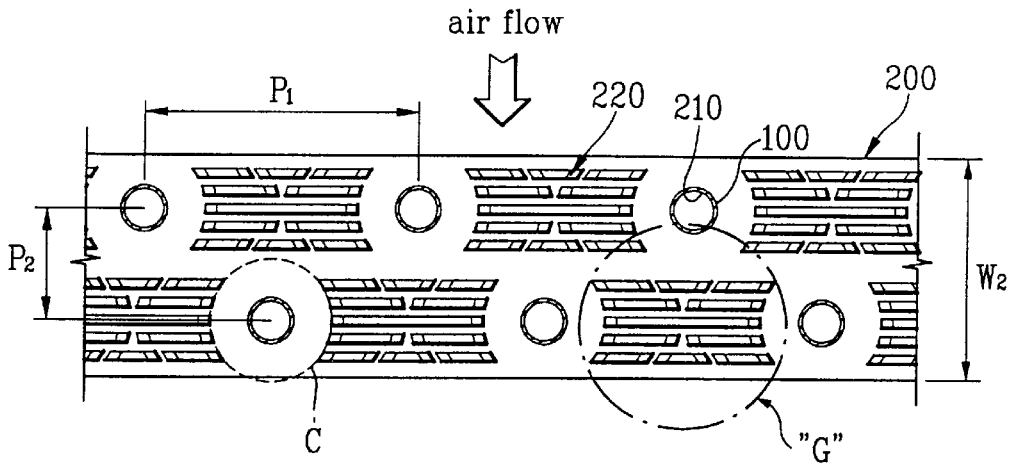
FIG. 23 is a sectional view taken along the line VIII—VIII of FIG. 22; and, FIG. 24 is an enlarged view of "G" part of FIG. 23.
Figure 24:
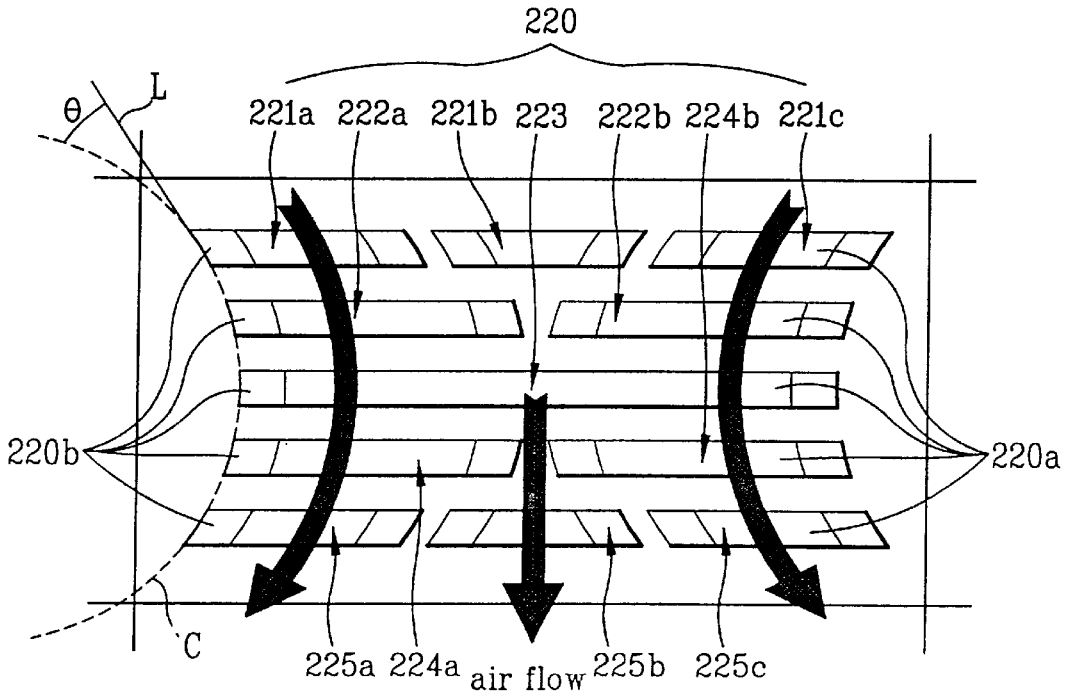

FIG. 22 is a partially sectional view of a fin and tube type heat-exchanger according to a seventh-preferred embodiment of the present invention. FIG. 23 is a sectional view taken along the line VIII—VIII of FIG. 22 and FIG. 24 is an enlarged view of "G" part of FIG. 23.

In the seventh embodiment according to the present invention, a number of slit groups, in each of which the slits 220 are arranged in five rows, are formed on each stage (the upper stage and the lower stage) of each cooling fin 200.

The distance ($P_1$) between the centers of two joint holes, which are arranged side by side at the same stage of the cooling fin 200, is about 19 mm~20 mm.

Furthermore, the distance ($P_2$) between the center of one joint hole formed at the upper stage of each cooling fin 200 and the center of another joint hole formed at the lower stage of each cooling fin 200 is about 10 mm~11 mm.

At this time, the slits 221 and 225 of third and fifth rows, on the basis of the direction of air flow, of the slits arranged in five rows are divided into three unit slits 221*a* to 221*c* and 225*a* to 225*c* respectively. The slits of second and fourth rows are divided into two unit slits 222*a*, 222*b*, 224*a* and 224*b*, and the slit of the third row is formed in a single segment.

Furthermore, the slits 220 arranged as the above are projected all in the same direction from one surface of the cooling fin 200.

At this time, the projecting distance of each slit is uniform generally and is ½ of the pitch ($P_3$) of the cooling fin, which is an interval between the cooling fins 200, so that the slits 220 are in a smooth contact with the air but does not have a noticeable influence on the movement of air flow.

At this time, the angle of each standing segment 220*b*, if a virtual circle (C) is formed along the vicinity of the circumference of the joint hole 210 of the cooling fin 200, is identical or similar with an angle (θ) formed between a virtual line made along the direction of the row of each slit and tangential line, which is tangent to the virtual circle (i.e., a line formed from both ends of each slit 220 toward the center of the virtual circle) (L).

The shape of each slit formed by the standing segment is shown in FIG. 24.

The unit slits 221*b* and 225*b*, located at the centers respectively, of the unit slits 221*a* to 221*c* and 225*a* to 225*c* located at the first and fifth rows on the basis of the direction of air flow are in the form of an equiangular trapezoid, in which the open portions are gradually reduced toward each other's row.

Furthermore, the unit slits 221*a*, 221*c*, 225*a* and 225*c* located at both sides of the central unit slits 221*b* and 225*b* are in the form of a parallelogram, which are inclined toward the central unit slits 221*b* and 225*b*.

Moreover, the unit slits 222*a*, 222*b*, 224*a* and 224*b* arranged at the second and fourth rows are in the form of a parallelogram, which are inclined toward the center of the slit 223 of the third row. The open portion of the slit 223 of the third row is generally in the form of a rectangle.

The heat-exchange process between the indoor air and the refrigerant moving inside the heat tube 100 by the fin and tube type heat-exchanger according to the seventh preferred embodiment will be described hereinafter in more detail.

First, the refrigerant entered from the refrigerant inlet side of the heat tubes 100 transfers its heat to the heat tubes 100 and the cooling fins 200 mounted in contact with the heat tubes 100 during passing through the heat tube 100.

At this time, the air moves from the outside of the heat-exchanger by the rotation of a fan (not shown). The air passes between the cooling fins 200, and passes the open portion of the slit of the first row in each slit group of the cooling fin.

At this time, the slit of the first row, which is divided into three unit slits 221*a*, 221*b* and 221*c*, allows the air flow to be distributed even generally by a guidance of the slits.

Furthermore, the air flow moving along the inside of each slit as described above, when passing the unit slits 222*a* and 222*b* of the second row, has a more even distribution of flow speed and is changed into turbulent flow again.

When passing the unit slits 224*a* and 224*b* of the fourth row and the unit slits 225*a* to 225*c* of the fifth row after passing the slit 223 of the third row, the air flow performs heat-exchange again and is diffused toward the rear side of the cooling fins 200 by the characteristics of the shape of each unit slit.

As described above, the collection and the diffusion of the air flow are induced by the standing segments 220*b* constituting each slit 220. The air flow moves along the circumferential direction of the heat tubes 100 by the guidance of the standing segments, thereby performing the smooth heat-exchange.

The movement of air flow has an influence onto the rear side of the heat tube 100, thereby preventing an occurrence of dead area of air flow, which was formed at the rear side of the conventional heat tube.

However, it is preferable that the turbulent flow of air is not high in its level and does not reduce heat-exchange efficiency.

The reason is that the slits 220 formed on each cooling fin 200 are projected from one surface of the cooling fin in the same direction to allow a smooth movement of air flow.

The heat-exchange efficiency is not reduced in spite of the functions described above, because the pitch ($P_3$) between the cooling fins 200 in the fin and tube type heat-exchanger according to the present invention is made smaller than that of the conventional heat-exchanger as well as the distances ($P_1$) ($P_2$) between the heat tubes passing through each cooling fin 200 are reduced.

The effects of the present invention are as follows.

First, the present invention, which is designed in such a manner that the distances between the rows and between the stages of the heat tubes are set in the optimum condition, so that the pressure loss is reduced but the heat-exchange efficiency is similar with or more increased than the prior arts.

Therefore, it causes a reduction of electric consumption because the same heat-exchange efficiency can be obtained with the lower electric power.

Furthermore, the noise produced by the operation of the heat-exchanger is also reduced, thereby improving users' reliability.

Additionally, the number of the heat tubes for manufacturing the heat-exchanger is reduced in use, so that not only the manufacturing cost can be reduced but also miniaturization of the heat-exchanger can be achieved.

It will be apparent to those skilled in the art that various modifications and variations can be made in a condenser microphone of the present invention without departing from the spirit or scope of the invention. Thus, it is intended that the present invention covers the modifications and variations of this invention provided they come within the scope of the appended claims and their equivalents.

What is claimed is:

1. A fin and tube type heat-exchanger, comprising:

a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein each slit of each row is divided into two unit slits; and a plurality of heat tubes passing through the joint holes of each cooling fin and joined with the joint holes respectively, each heat tube having a diameter of 5~6 mm or smaller and allowing refrigerant to move therein, wherein the distance between the centers of two joint holes, which are arranged side by side at the same stage of the cooling fin, is approximately 19 mm~20 mm.

2. A fin and tube type heat-exchanger as claimed in claim 1, wherein the standing segments are inclined inwardly in such a manner that the unit slits of first and second rows on the basis of the direction of air flow are in the form of a parallelogram, which are inclined toward the center of the slit group on the basis of the center between the unit slits of the second row and the unit slits of a third row, and wherein the standing segments of the slits of third and fourth rows are inclined outwardly in such a manner that the unit slits of the third and fourth rows are symmetric with the unit slits of the second and first rows.

3. A fin and tube type heat-exchanger as claimed in claim 1, wherein the distance between the center of one joint hole formed at one stage of the cooling fine and the center of another joint hole formed at another stage of the cooling fin is approximately 10 mm~11 mm.

4. A fin and tube type heat-exchanger, comprising:

a plurality of cooling fins arranged at predetermined intervals, each cooling fin having a number of joint holes which are formed on the surfaces thereof and arranged in at least one or more stages and a number of slits disposed at spaces between the joint holes formed on each stage in one surface of the cooling fins, each slit having a projecting segment which has an open portion opened correspondingly to the direction of air flow and a pair of standing segments formed at both sides of the projecting segment for guiding the direction of air flow, the projecting segments of the slits being projected in the same direction from the surface of each cooling fin, the slits being grouped by four rows, wherein each slit of each row is divided into two unit slits; and a plurality of heat tubes passing through the joint holes of each cooling fin and joined with the joint holes, respectively, each heat tube having a diameter of 5~6 mm or smaller and allowing refrigerant to move therein, wherein the distance between the center of one joint hole formed at one stage of the cooling fin and the center of another joint hole formed at another stage of the cooling fin is approximately 10 mm~11 mm.

* * * * *